United States Patent [19]

Miner

[11] Patent Number: 4,896,376

[45] Date of Patent: Jan. 30, 1990

[54] SPORT GLOVE CONSTRUCTION AND METHOD OF MAKING SAME

[76] Inventor: Monte A. Miner, 150 13th Street, Del Mar, Calif. 92014

[21] Appl. No.: 147,688

[22] Filed: Jan. 25, 1988

[51] Int. Cl.[4] ..... A41D 19/00

[52] U.S. Cl. ..... 2/19; 2/161 A

[58] Field of Search ..... 2/19, 161 A, 161 R

[56] References Cited

U.S. PATENT DOCUMENTS

| | | | |
|---|---|---|---|
| 2,113,934 | 4/1938 | Denkert | 2/19 |
| 2,510,218 | 6/1950 | Goldsmith et al. | 2/19 |
| 2,681,448 | 6/1954 | Tomkins | 2/19 |
| 4,279,681 | 7/1981 | Klimezky | 2/19 |
| 4,651,345 | 3/1987 | Latina | 2/19 |
| 4,665,561 | 5/1987 | Aoki | 2/19 |

*Primary Examiner*—Werner H. Schroeder
*Assistant Examiner*—Jeanette E. Chapman
*Attorney, Agent, or Firm*—Bernard L. Kleinke; William Patrick Waters; Jerry R. Potts

[57] ABSTRACT

A sport glove construction and a method of using it, includes fastening together sheets of plastic material by rigid fastening device into a cup-shaped pocket configuration, forming a front ball receiving side and a rear hand receiving side having a cup-shaped pocket therein. A hand securing device is connected to the outer surface of the back side of the glove construction for proper ventilation purposes. A web device interconnects right and left portions of the front and rear sheets, to help define the pocket. Right and left elongated, resilient pads extend in a generally U-shaped configuration at the rim of the pocket, diverging away from one another at the lower portion of the sheets toward the web device. A plurality of pocket rigid fastening devices are arranged in a spaced apart manner within the pocket adjacent to the pads and secure together the front and rear sheets for helping rigidify flexibly the resulting glove construction.

22 Claims, 1 Drawing Sheet

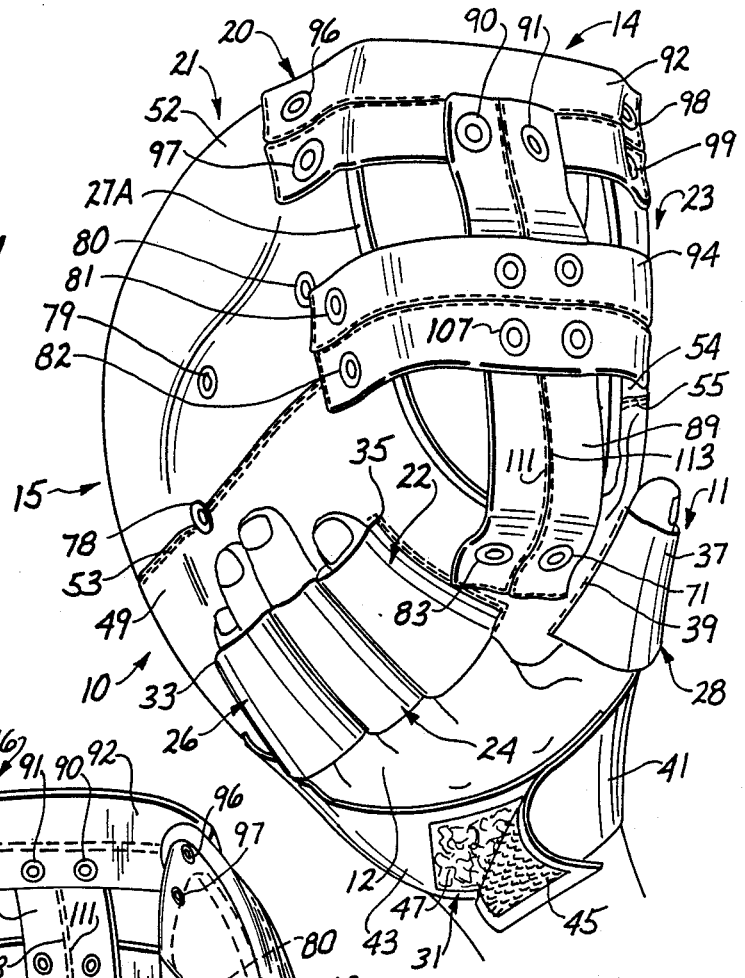
FIG 1
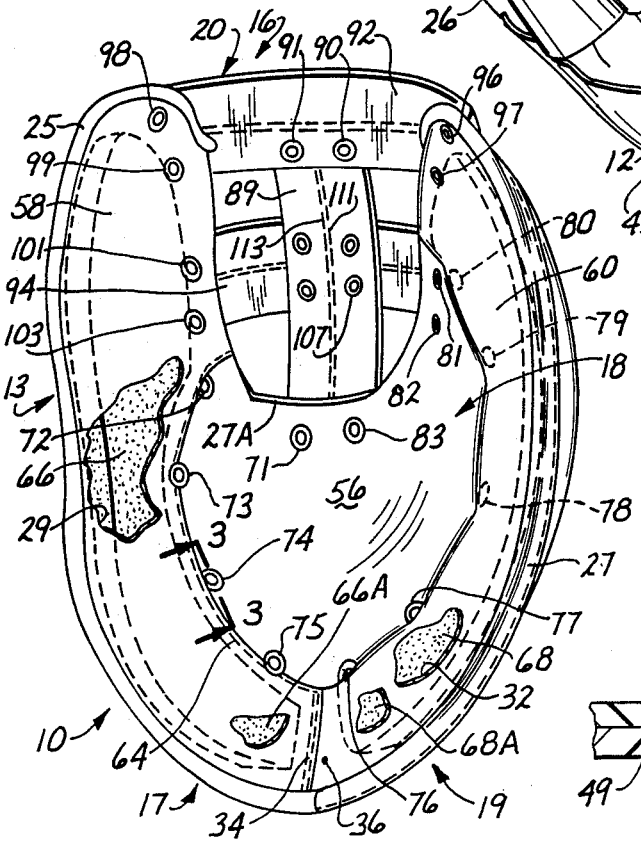
FIG. 2
FIG. 3
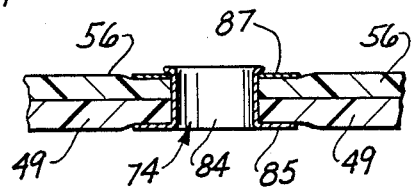

SPORT GLOVE CONSTRUCTION AND METHOD OF MAKING SAME

Description

1. Technical Field

The present invention relates in general to a sport glove construction, and a method of making it. The invention more particularly relates to a sport glove construction, such as a glove designed to catch balls, and a method of making the glove construction from pliable sheet plastic material.

2. Background Art

There are various different types and kinds of sport gloves. For example, baseball gloves are used for catching baseballs, and are usually made from leather material. Such sport gloves are necessarily made of a durable material which is formed from a relatively stiff material, and retains its shape. Such material enables the glove to assume a desired contour so that a suitable pocket therein is retained for receiving readily a ball in a convenient manner. However, the material must be sufficiently supple and pliable so that the user can readily close the glove about the ball to retain it in the pocket after catching it.

While such leather gloves have been suitable for many applications, it would be highly desirable to manufacture a sport glove according to modern, high-speed manufacturing techniques, from pliable sheet plastic material or other such material. In this regard, such a glove would be water repellent, and therefore, could be used in water sports, as well as conventional ball games, such as baseball.

There have been numerous attempts at making such a glove. For example, reference may be made to the following U.S. Pat. Nos.: 244,886; 573,447; 1,083,795; 1,179,581; 1,185,411; 1,679,836; 2,100,491; 2,662,225; 3,174,167; 3,898,696; 4,058,863; 4,227,263; 4,366,580; and 4,651,345.

None of the foregoing patents disclose a glove made from sheet plastic material, which has a suitable pocket configuration useful in the catching and retaining of a ball. In this regard, it would be highly desirable to have such a ball glove which is made substantially entirely from plastic material, so that the glove can be used in a game of catch, in almost any location. In this regard, such a glove could be used at the beach, swimming pools, or any other suitable place, without the risk of damaging the glove by contact with water, including sea water. Such a glove should also be useful for the game of baseball in a conventional manner as well.

The reason why a ball glove composed of sheet plastic material can not readily be made in a suitable shape-retaining manner, is that the material is so limp that it does not properly assume and retain a desired cup-shaped pocket configuration. This is especially true after repeated use of the glove, since the repeated impact with the ball tends to render the material even more limp.

Additionally, when employing a plastic material for the sport glove construction, such material does not readily "breath." Therefore, the hand of the user tends to perspire and be uncomfortable during use. The perspiration renders a smooth plastic glove slippery, and thus more difficult to manipulate.

Thus, it would be highly desirable to have a new and improved sport glove construction, which eliminates, or at least greatly reduces, the problem of having a plastic sport glove that retains a suitable pocket, to facilitate the receiving of a ball. Also, such a plastic glove should not be uncomfortable to wear and to use. In this regard, it should not cause the hand of the user to perspire to great extent. Also, if used in water areas, such as beaches, or swimming pools, water can collect inside the hand receiving portion in an unsatisfactory and unwanted manner.

Disclosure of Invention

Therefore, the principal object of the present invention is to provide a new and improved sport glove construction and a method of making it, whereby the construction materials include pliable sheet plastic materials and the resulting glove construction has shape-retaining characteristics.

Another object of the present invention is to provide such a new and improved sport glove construction and a method of making it, whereby the glove construction includes sheet plastic material and yet the glove construction permits comfortable use thereof.

Briefly, the above and further objects of the present invention are realized by providing a new sport glove construction and a method of making it, in a comfortable and convenient manner, and where the sport glove has shape retaining characteristics despite the use of pliable sheet plastic material.

A sport glove construction and a method of using it, includes fastening together front and rear sheets of plastic material by rigid fastening devices into a cup-shaped pocket configuration, forming a front ball receiving side and a rear hand receiving side having a cup-shaped pocket therein. A hand securing device is connected to the outer surface of the back side of the glove construction for proper ventilation purposes.

The inventive construction provides a ball receiving pocket, which is partially defined by the pads, and the pocket fastening devices. As a result, the glove construction provides inherent shape and configuration retaining properties, and yet permits the user to manipulate the glove freely and easily during use thereof.

The hand securing device on the back side, is so constructed and arranged that the hand of the user does not readily perspire perfusely and remains comfortable while manipulating the glove. The hand is not required to be totally enclosed within the glove, as required in the typical prior known ball glove. A web device interconnects right and left portions of the front and rear sheets, to help define the pocket. Right and left elongated, resilient pads extend in a generally U-shaped configuration at the rim of the pocket, diverging away from one another at the lower portion of the sheets toward the web device. A plurality of pocket rigid fastening devices are arranged in a spaced apart manner within the pocket adjacent to the pads and secure together the front and rear sheets for helping rigidify flexibly the resulting glove construction.

Brief Description of Drawings

The above mentioned and other objects and features of this invention and the manner of attaining them will become apparent, and the invention itself will be best understood by reference to the following description of an embodiment of the invention in conjunction with the accompanying drawings, wherein:

FIG. 1 is a rear side pictorial view of a glove construction, which is made according to the present invention, and which is shown being worn on the left hand of the user;

FIG. 2 is a fragmentary, front pictorial view of the catching side of the glove construction of FIG. 1; and FIG. 3 is an enlarged sectional view of the glove construction of FIG. 2, taken substantially on line 3—3 thereof, illustrating a rigid fastening device.

Best Mode for Carrying Out the Invention

Referring now to the drawings, and more particularly to FIGS. 1 and 2 thereof, there is shown a glove construction 10, which is made in accordance with the present invention, and which is adapted to be worn by the hand of the user, such as by a left hand 12. While a left hand glove construction is shown and described herein, it should be understood that a right hand version of the inventive glove construction is also contemplated by the present invention. Also, while the glove construction 10 shown and described herein as being a catcher's baseball mit or a first baseman's mit for use in the game of baseball, the glove construction of the present invention may also be modified to be used for other positions of play in the game of baseball, or for other games, as will become apparent to those skilled in the art.

As shown in FIG. 2, the glove construction 10 generally comprises a front catching or ball receiving side 16 having a cup-shaped pocket 18 therein, which is partially defined by a web 20. The pocket 18 is used for the purpose of catching a ball (not shown), such as a baseball.

As shown in FIG. 1, on the rear hand receiving side 14, there is a hand securing device generally indicated at 11, and includes a set of finger holds 22, 24 and 26 which receive the four fingers of the hand 12. A thumb hold generally indicated at 28 receives the thumb of the hand 12. A wrist hold 31 surrounds the back of the hand 12 at the wrist of the user As shown in FIGS. 1 and 2, the glove construction 10 includes a plurality of front sheets generally indicated at 13 (FIG. 2), and a plurality of rear sheets generally indicated at 15 (FIG. 1). The sheets are each composed of pliable plastic material, and are sewn or otherwise fastened together as hereinafter described in greater detail, to form the glove of the present invention.

The front side 16 has a left side portion 17 and a right side portion 19. Similarly, the rear side 14 has a left side portion 21 and a right side portion 23. The left front side portion 17 is sewn to the right rear side portion 23 and secured together at their marginal edges by a welting 25 (FIG. 2). The right front side portion 19 is similarly affixed to the left rear side portion 21 by a welting 27 (FIG. 2).

The web 20 interconnects the left rear side portion 21 and the right rear side portion 23. A U-shaped welting 27A extend continuously along the web-interconnecting inner marginal edges of the front and rear sides at the upper portion of the rear side 14 and is sewn in place.

As shown in FIG. 2, a pair of right and left elongated resilient pads 66 and 68 extend in a generally U-shaped configuration at the rim of the pocket 18. Each one of the pads is composed of an impact absorbing material, which is a closed cell foam material to prevent water absorption. The pads diverge away from one another at the lower portion of the glove construction 10 toward the web 20 at the upper portion thereof.

The pad 66 is secured in place within a closed pocket or compartment 29 formed by the fastened together front and rear sides 16 and 14. Similarly, the pad 68 is enclosed entirely within a closed pocket or compartment 32 between another portion of the sewn together front and rear sides 16 and 14.

The bottom ends 66A and 68A of the respective pads 66 and 68 are positioned in a spaced apart manner and are separated by a line of stitching 34 (FIG. 2) forming a seam space 36 between the compartments 29 and 32. The spacing between the pad ends 66A and 68A is sufficient to permit the hand 12 of the user to close the ball receiving pocket 18 to catch and retain a ball (not shown). In this regard, in order to collapse the pocket 18 about the ball for retaining it in place, the user's thumb pushes the right rear side 23, and the user's fingers pushes the left rear side 21, to move the right and left sides toward one another. In so doing, the pads are able to move toward one another, due to the space 36 between the pads.

During a closing manipulation, the cup-shaped web flexes and buckles to permit the closing of the glove about the ball to grip it in position. Also, a base sheet 56 (FIG. 2) flexes and buckles to permit the closing operation.

Thus, the pads 66 and 68 help rigidify the construction of the glove, and yet the pocket 18 can be closed about a ball during a ball catching manipulation. In order to help rigidify the construction 10 in the area of its pocket 18, and to enhance its scoop shape retaining characteristics, a series of spaced-apart like rigid fastening devices 71 through 83 are arranged within the pocket 18 adjacent to the compartments 29 and 32 containing the respective pads 66 and 68. The devices 71—83 also complete the compartments 29 and 31 for retaining the pads in place. Also, the devices 71—83 help drain water from the inside of the pocket 18.

Each one of the fastening devices is a washer grommet, which extends through and connects together the front and rear sides 16 and 14 within the area of the pocket 18. The rigid metal washer grommets serve to help rigidify the structure, as well as fastening together the front and rear sides. Moreover, the fastening devices 71, 81, 82 and 83 also serve to affix portions of the web 20 to the rear side 14.

Considering now the finger holds in greater detail, a finger strap 33 is affixed to the outer surface of the rear hand receiving side 14 by means of a continuous line of stitching 35 to form three separate loops for the three finger holes 22, 24 and 26. The loop 26 is sufficiently large to receive both the little finger and the ring finger of the hand 12. However, the preferred manner of wearing the glove is to position the little finger outside of the loop 26, so that the little finger moves the pad 68 to close about a ball received in the pocket 18.

The strap 33 is composed of a soft, flexible fabric material, such as a stretchable terry cloth material, which is of an opened weave to permit the breathing of the fingers. Also, such material tends to absorb moisture, such as perspiration from the hand, and grips the fingers and the thumb loosely and comfortably. Thus, the loose connection helps facilitate the operation of the glove, and also permits water drainage.

The strap 33 only extends across a portion of the fingers, and thus the tip portion of the fingers and the remaining portion of the hand are exposed to the air for cooling purposes.

The thumb holds 28 include a thumb strap 37 which is affixed to the rear hand receiving side 14 by means of a line of stitching 39, in a similar manner as the strap 33 is connected in place. Thus, the strap 37 forms a loop for receiving the thumb of the hand 12. The thumb extends entirely through the loop so that the tip portion of the thumb is exposed to the air for cooling purposes. The strap 37 is composed of similar material as the strap 33.

The wrist hold 31 includes a pair of wrist straps 41 and 43 which are connected together by means of releasably mating patches 45 and 47 for interconnecting releasably the free ends of the wrist straps. The other ends of the wrist straps are suitably connected fixably to the rear side 14 by stitching (not shown). The wrist straps are composed of similar material as the finger straps 33.

Considering now the rear hand-receiving side 14 in greater detail, the rear side includes a base sheet 49, which is one of the sheets 15 composed of suitable pliable plastic material. A pair of outer upper portion sheets 54 are also composed of similar material and are stitched at 53 and 55 to the base sheet 49, to help define the compartment 29.

Considering now the front side 16 in greater detail, the front side includes a base sheet 56, which is one of the front sheets 13. A pair of outer elongated sheets 58 and 60 are sewn to the base sheet at 62 and 64 respectively. The stitching 62 and 64 help define the respective pad confining compartments 29 and 32.

A series of washer grommets, such as the washer grommets 71 and 73 interconnect the front and rear sheets as shown in the drawings.

As shown in FIG. 3, each one of the fastening devices, such as the device 74, is a washer grommet having a tubular shank part 84 having an annular base 85 and a crimped edge 86 to secure it fixedly to an annular washer part 87. The washer part helps prevent the sheet material from pulling away from the grommet. In this manner the sheets 49 and 56 are affixed therebetween.

Considering now the web 20 in greater detail with reference to FIG. 1, the web 20 generally comprises a longitudinal strap 89 connected at its lower end to the base sheet 49 by the fastening devices 71 and 83, and at its upper end by a pair of fastening devices 90 and 91 to a transverse strap 92. A set of two pairs of fastening devices 96 and 97, and 98 and 99 secure the opposite ends of the transverse strap 92 to the rear side 14.

Intermediate the ends of the longitudinal strap 89, is affixed thereto a transverse strap 94, which is connected at one of its ends to the sheet 52 by the fastening devices 81 and 82. At its opposite end, a pair of fastening devices 101 and 103 attach the strap 94 to the sheet 54. A set of fastening devices, such as the device 107 connect the central portion of the transverse strap 94 to the longitudinal strap 89.

The straps 89, 92 and 94 are each similar to one another. Therefore, only the longitudinal strap 89 will now be described. The strap 89 is composed of the same sheet plastic material as the sheets 13 and 15, and is reversely folded over along both of its marginal edges. Both marginal edges are sewn longitudinally at 111 and 113.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A sport glove construction, comprising:

front and rear pliable plastic sheets being disposed in overlying, opposed relationship and forming a front ball receiving side and a rear hand receiving side, said ball receiving side having a cup-shaped pocket therein for receiving a ball therein;

hand securing means securing to the outer surface of said rear sheet for receiving the hand of the user and for holding it in position on said outer surface of said rear sheet;

said front and rear sides each having a right and left portion;

web means interconnecting said right and left portions to help define said pocket;

right and left elongated pad means extending in a generally U-shaped configuration at the rim of said pocket, said pad means being composed of resilient impact absorbing material;

said pad means diverging away from one another at the lower portion of said sheet means toward said web means; and a plurality individually spaced apart rigid fastening devices being arranged in a spaced apart manner within said pocket adjacent to said pad means and securing together said front and rear sheets for helping rigidify the flexibility of said glove construction.

2. A glove construction according to claim 1, wherein said right and left pad means are spaced apart at the bottom portion of said glove construction to provide a spacing to permit said pad means to be moved toward one another.

3. A glove construction according to claim 1, wherein said hand securing means includes finger old means for receiving the fingers of the user, and thumb hold means for receiving the thumb of the user.

4. A glove construction according to claim 3, wherein said finger hold means includes a finger strap sewn to one side of the outer surface of said rear side to form a plurality of U-shaped loops, and said thumb hold means includes a thumb strap sewn to the other side of the outer surface of said rear side to form a U-shaped loop.

5. A glove construction according to claim 3, wherein said hand securing means includes wrist hold means for receiving the wrist of the user.

6. A glove construction according to claim 5, wherein said wrist hold means includes a pair of wrist straps each sewn at one of its ends to the lower portion of said rear side and secured releasably at their free ends to one another.

7. A glove construction according to claim 6, further including hook and pile means for interconnecting releasably the free ends of said wrist straps.

8. A glove construction according to claim 1, wherein said web means includes longitudinal and transverse flexible interconnected strips, and each one of said strips is formed by a pair of reversely folded marginal longitudinal edges sew together.

9. A glove construction according to claim 8, wherein said strips are affixed to said rear sides by a plurality of web rigid fastening devices, and said strips are affixed together by strip rigid fastening devices.

10. A glove construction according to claim 9, wherein said rigid fastening devices are similar to one another and are composed of metal material.

11. A glove construction according to claim 10, wherein each one of said fastening devices is a washer grommet.

12. A glove construction according to claim 1, wherein said web means is composed of pliable sheet plastic material.

13. A glove construction according to claim 1, wherein said hand receiving means is composed of stretchable terry cloth material.

14. A method of making a sport glove construction, comprising:

positioning front and rear pliable plastic sheets in overlying relationship and forming a front ball receiving side and a rear hand receiving side having a cup-shaped pocket therein;

securing said receiving means to the outer surface of said sheet for receiving the hand of the user and for holding it in position on said outer surface of said rear sheet;

interconnecting web means with right and left portions to help define said pocket;

affixing right and left elongated, resilient pad means extending in a generally U-shaped configuration at the rim of said pocket diverging away from one another at the lower portion of said sheet means toward said web means; and arranging a plurality individually spaced apart rigid fastening devices within said pocket adjacent to said pad means and securing together said front and rear sheets for helping rigidify the flexibility of said resulting glove construction.

15. A method according to claim 14, further including spacing apart said right and left pad means at the bottom portion of said glove construction to provide a spacing to permit said pad means to be moved toward one another.

16. A method according to claim 15, including forming said web means by using strips, wherein each one of said strips is formed by a pair of reversely folded marginal longitudinal edges sewn together.

17. A method of making a sport glove construction, comprising;

positioning front and rear sheet means in overlying relationship and forming a front ball receiving side and a rear hand receiving side having a cup-shaped pocket therein;

securing said receiving means to the outer surface of said sheet means for receiving the hand of the user and for holding it in position on said outer surface of said rear sheet means;

interconnecting web means with a right and left portions to help define said pocket;

affixing right and left elongated, resilient pad means extending in a generally U-shaped configuration at the rim of said pocket diverging away from one another at the lower portion of said sheet means toward said web means;

arranging a plurality individually spaced apart rigid fastening devices within said pocket adjacent to said pad means and securing together said front and rear sheet means for helping to rigidify the flexibility of said resulting glove construction;

spacing apart said right and left pad means at the lower portion of said sheet means to provide a spacing to permit said pad means to be moved toward one another;

forming said web means by using strips, wherein each one of said strips is formed by a pair of reversely folded marginal longitudinal edges sewn together;

affixing said strips together by a plurality of strip rigid fastening devices; and affixing said strips to said rear sides by a plurality of web rigid fastening devices.

18. A method according to claim 17, further including the steps of:

using fastening devices similar to one another and composed of metal material.

19. A method according to claim 18, further including the step of:

using a washer grommet as a fastening device.

20. A method of making a sport glove construction, comprising:

positioning front and rear sheets of pliable plastic material in overlying relationship and forming a front ball receiving side and a rear hand receiving side having a cup-shaped pocket therein;

securing said receiving means to the outer surface of said sheets of pliable plastic material for receiving the hand of the user and for holding it in position on said outer surface of said rear sheets of pliable plastic material;

interconnecting web means with right and left portions to help define said pocket;

affixing right and left elongated, resilient pad means extending in a generally U-shaped configuration at the rim of said pocket diverging away from one another at the lower portion of said sheets of pliable plastic material toward said web means; and arranging a plurality individually spaced apart rigid fastening devices within said pocket adjacent to said pad means and securing together said front and rear sheets of pliable plastic material for helping rigidify the flexibility of said resulting glove construction.

21. A glove construction according to claim 1, wherein said pad means is composed of an impact absorbing material.

22. A glove construction according to claim 1, wherein said impact absorbing material is a closed cell foam material to prevent water absorption.

* * * * *

UNITED STATES PATENT AND TRADEMARK OFFICE

CERTIFICATE OF CORRECTION

PATENT NO. :4,896,376

DATED :January 30, 1990

INVENTOR(S) :Monte A. Miner

It is certified that error appears in the above-identified patent and that said Letters Patent is hereby corrected as shown below:

Column 6, line 38, after "finger", delete "old" and substitute therefor --hold--.

Column 7, line 45, after "comprising", delete ";", and substitute therefor --:--.

Signed and Sealed this

Seventh Day of May, 1991

*Attest:*

*Attesting Officer*

HARRY F. MANBECK, JR.

*Commissioner of Patents and Trademarks*